US012673255B2

(12) United States Patent
Malpica et al.

(10) Patent No.: US 12,673,255 B2
(45) Date of Patent: Jul. 7, 2026

(54) TABLETOP GAME AND CONDIMENT HOLDER

(71) Applicants: Ivan Malpica, Lake Mary, FL (US); Eliel Malpica, Saint Louis, MO (US)

(72) Inventors: Ivan Malpica, Lake Mary, FL (US); Eliel Malpica, Saint Louis, MO (US)

( * ) Notice: Subject to any disclaimer, the term of this patent is extended or adjusted under 35 U.S.C. 154(b) by 995 days.

(21) Appl. No.: 17/750,221

(22) Filed: May 20, 2022

(65) Prior Publication Data

US 2023/0372808 A1 Nov. 23, 2023

(51) Int. Cl.
*A63F 3/00* (2006.01)

(52) U.S. Cl.
CPC ..... *A63F 3/00261* (2013.01)

(58) Field of Classification Search
CPC ..... A63F 3/00261; A63F 2009/0033; A63F 9/001; A63F 2003/0034; A63F 2009/0286; A63F 9/02; A63F 7/28; A63F 2250/22; A47G 21/16; A47G 23/00; A47K 10/427; B65D 25/04; G06Q 50/12
USPC ..... D7/590, 600; D3/313
See application file for complete search history.

(56) References Cited

U.S. PATENT DOCUMENTS 3,295,692 A * 1/1967 Ellcey ..... A47G 19/24 211/74
4,799,744 A * 1/1989 Toy ..... A47J 47/16 211/184
D549,524 S * 8/2007 White, III ..... D7/590

* cited by examiner

*Primary Examiner* — Michael D Dennis
(74) *Attorney, Agent, or Firm* — Jason T. Daniel, Esq.; Daniel Law Offices, P.A.

(57) ABSTRACT

A tabletop game and condiment holding device includes a main body having a top wall, a bottom wall, a back wall, a front wall, a pair of side walls, and a curved wall that extends from the top wall to the front wall. The curved wall forming a ramp for discharging a coin in a direction away from the front wall. A napkin dispenser and a plurality of condiment holders are positioned along the walls of the main body. A drawer having a plurality of sidewalls and a common top surface is removably positioned within the front wall. A plurality of apertures located along the top surface of the drawer function to receive the coin in flight. A template having markings and a plurality of complementary shaped and located apertures is removably secured along the top surface of the drawer.

9 Claims, 3 Drawing Sheets

TABLETOP GAME AND CONDIMENT HOLDER

TECHNICAL FIELD

The present invention relates generally to the restaurant and service industry, and more particularly to a combination tabletop game and condiment holder.

BACKGROUND

The statements in this section merely provide background information related to the present disclosure and may not constitute prior art.

Dining establishments such as restaurants, bars and coffee shops, for example, provide customers with tables to enjoy meals and other food or beverage related items. In this regard, it is customary for such establishments to provide patrons with certain condiments such as salt, pepper, seasoning sauces, and/or napkins, for example, which are typically positioned within one or more holders on the tabletop.

Although useful for their intended purpose, such devices tend to be large, bulky units that take up a significant amount of table space and are only used periodically throughout the meal. As such, these devices do nothing to enhance the entertainment aspect of the customer, and therefore do not create a positive return on investment. Accordingly, it would be beneficial to provide a condiment holder having an integrated table game that can provide entertainment to customers while storing and dispensing condiments.

The present invention, directed to a tabletop game and condiment holder differs from the conventional art in a number of aspects. The manner by which will become more apparent in the description which follows, particularly when read in conjunction with the accompanying drawings.

SUMMARY OF THE INVENTION

The present invention is directed to a tabletop game and condiment holding device. One embodiment of the present invention can include a main body having a top wall, a bottom wall, a back wall, a front wall, a pair of side walls, and a curved wall that extends from the top wall to the front wall. The curved wall forming a ramp for discharging a coin, such as a quarter, for example, in a direction away from the front wall.

In one embodiment, a napkin dispenser can be positioned along the back wall of the main body and a plurality of condiment holders can be positioned along the sides of the main body.

In one embodiment, a drawer is removably positioned within an opening in the front wall of the main body, said drawer including a plurality of sidewalls and a common top surface. In one embodiment, a plurality of apertures can be positioned along the top surface of the drawer so as to receive the coin in flight. Each of the apertures including a shape and size that is suitable for receiving the coin.

A template can be removably secured along the top wall of the drawer. The template can include apertures that are complementary in shape and size as the apertures on the drawer, and can also include markings such as instructions, menu items or promotional materials.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), a thin, flexible strap with a notched surface and one end threaded through a locking mechanism (i.e., zip tie) at the other, tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

Figure 1:
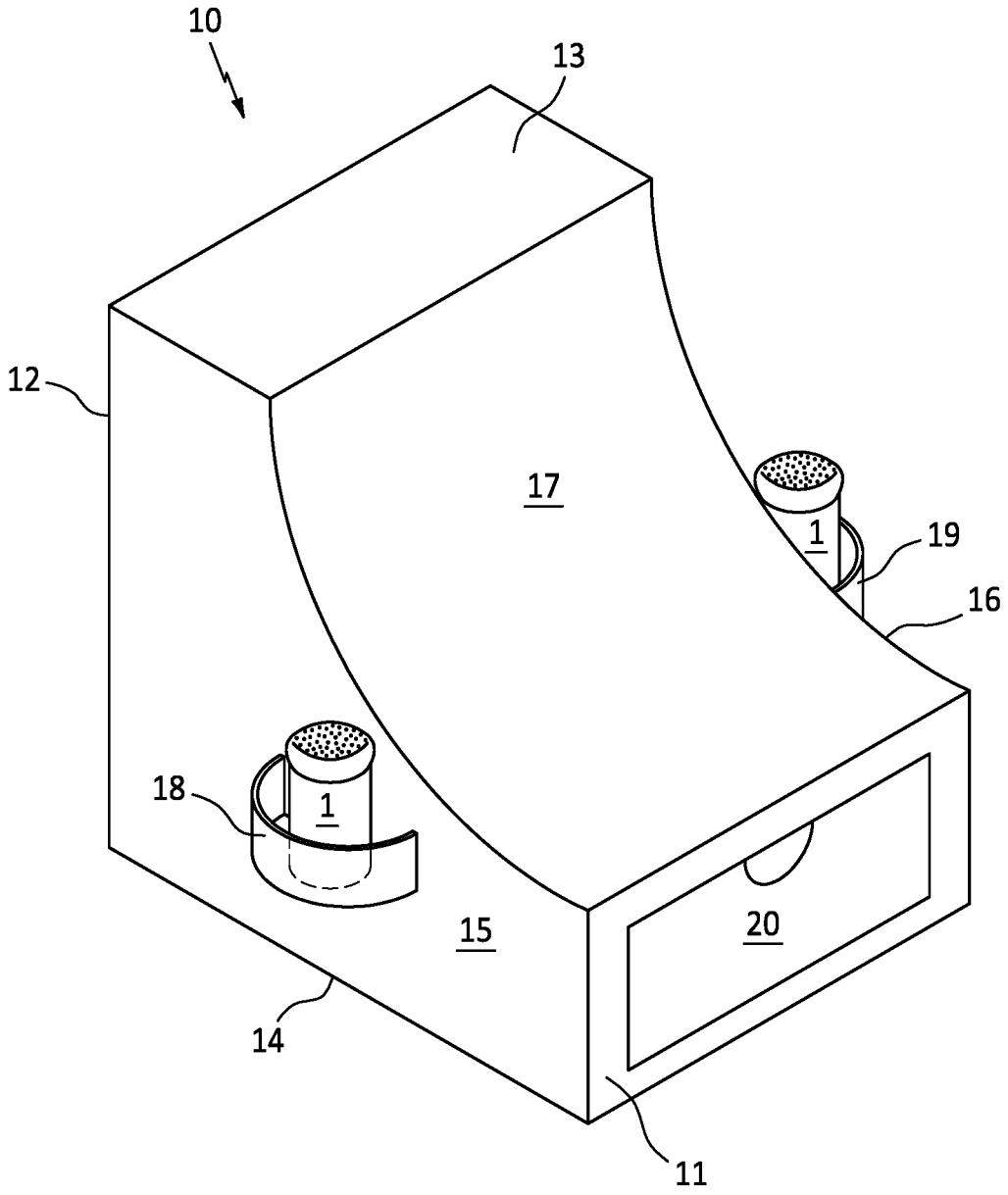
FIG. 1 is a perspective view of a tabletop game and condiment holder that is useful for understanding the inventive concepts disclosed herein.
Figure 2:
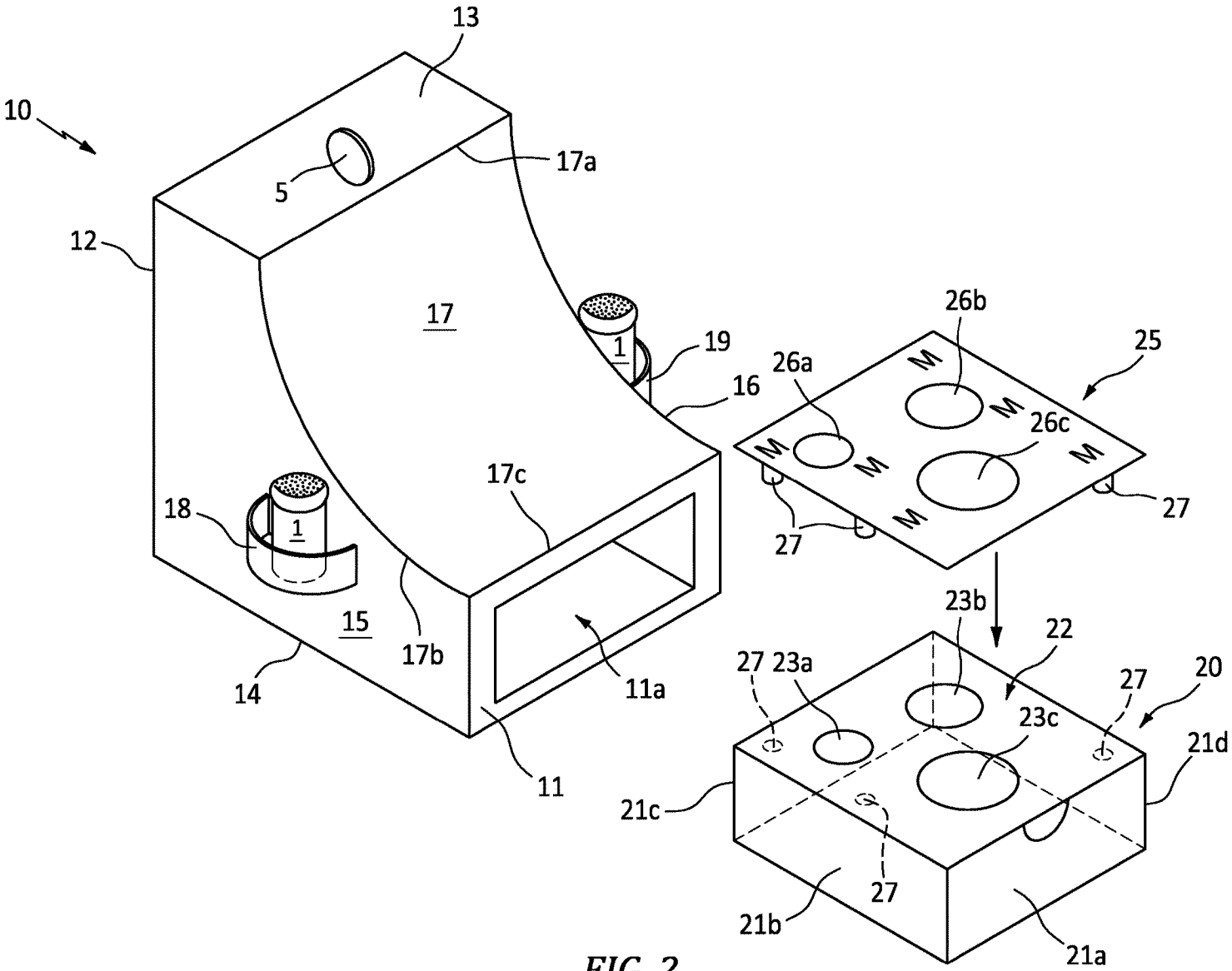
FIG. 2 is another perspective view of the tabletop game and condiment holder in operation, in accordance with one embodiment of the invention.
Figure 3:
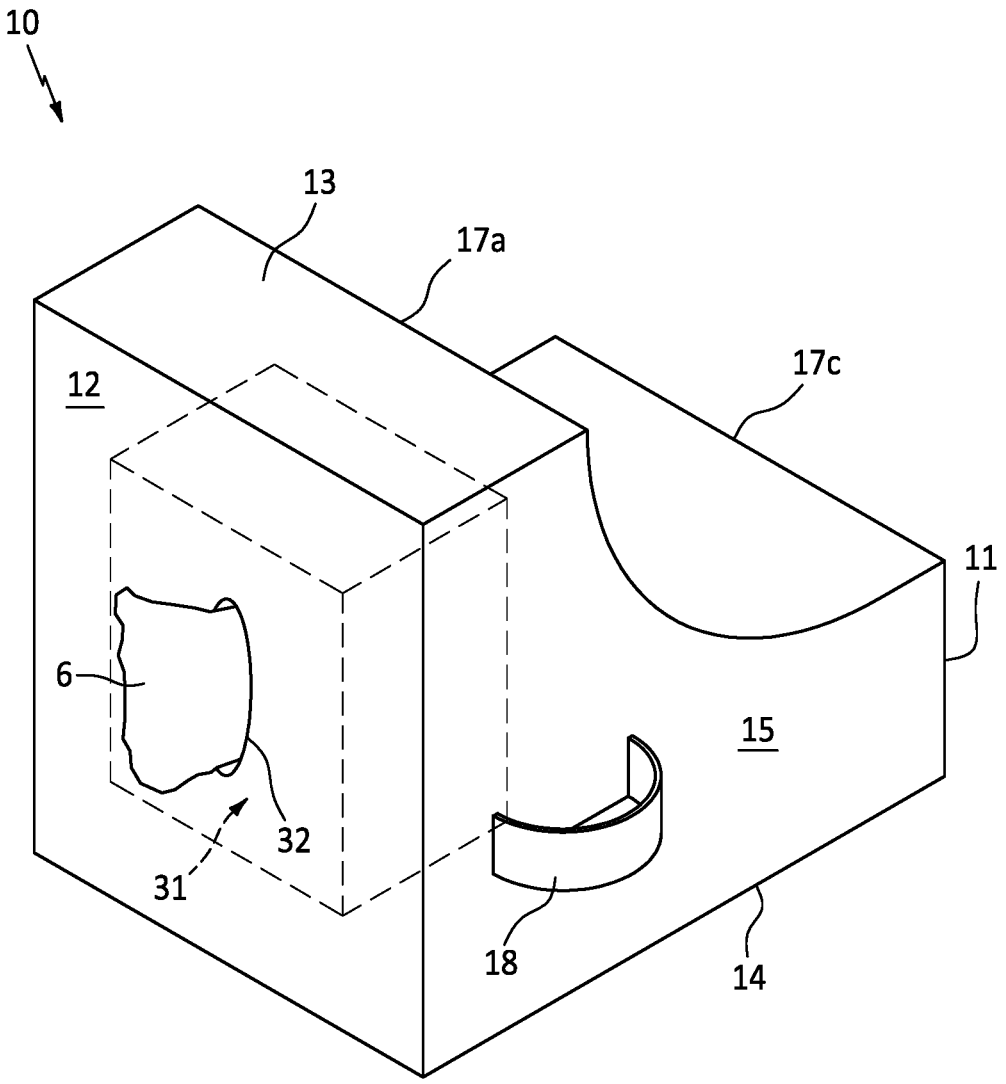
FIG. 3 is a back side of the tabletop game and condiment holder, in accordance with one embodiment of the invention.

FIGS. 1-3 illustrate one embodiment of a tabletop game and condiment holder 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown, the device 10 can include a main body having a front wall 11, a back wall 12, a top wall 13, a bottom wall 14, a pair of opposing side walls 15-16, and a curved wall 17 extending from the top wall to the front wall. Each of the walls forming a generally hollow interior space suitable for receiving any number of dining accessories.

In one embodiment, a pair of condiment receptacles 18 and 19 can be positioned along sidewalls 15 and 16, respectively. Receptacles 18 and 19 can include any number of different shapes and sizes, and can function to receive and store condiment containers 1 such as salt and pepper, or seasoning sauces (e.g., ketchup, steak sauce, barbecue sauce, etc.). Although shown with regard to curved elements any number of other shapes and sizes are also contemplated. Moreover, although illustrated with regard to two distinct receptacles, other embodiments are contemplated wherein the main body includes additional receptacles located along the main body.

In the preferred embodiment, the curved wall 17 can include a first end 17*a*, a bend 17*b* and a second end 17*c*. The curved wall can be constructed such that the bend 17*b* is positioned beneath the second end 17*c* in order to form a ramp for allowing a coin 5 to travel the length of the curved wall before exiting the wall and flying away from the front wall 11.

As shown best at FIG. 2, the main body can include a drawer 20 that is selectively positioned within an opening 11*a* in the front wall 11. As shown, the drawer can include a plurality of sidewalls 21*a*, 21*b*, 21*c* and 21*d* along with a top wall 22 that is positioned along the upper edges of the sidewalls. In the preferred embodiment, a plurality of apertures can be disposed along the top wall 22 and can function to receive the coin 5 that has been launched from the curved wall 17, as described above.

In the illustrated embodiment two circular apertures 23*a*-23*b*, and one elongated oval aperture 23*c* are provided along the top wall. However, this is for illustrative purposes only, as other embodiments are contemplated wherein the top wall includes a different number of apertures and/or apertures having a different shape or size.

In either instance, one embodiment of the device 10 can include a template 25 having a shape and size that is complementary to the shape and size of the top wall 22. The template can also include a complementary number of apertures, such as apertures 26*a*, 26*b* and 26*c*, for example, each having a complementary shape, size and location as apertures 23*a*-23*c*, respectively. The template can be positioned over the top wall 22 and can include any type of markings M such as instructions for game play, menu items, advertisements or any other such information as may be desirable to display to a customer while utilizing the game. In this regard, the template can be removably affixed onto the top wall utilizing any number of different connectors 27, so as to permit an establishment to regularly change the template in order to change the content that is displayed.

As shown in FIG. 3, the device 10 can be configured to dispense napkins, and can include a pocket area 31 within the main body and an opening 32 through which napkins 6 can be dispensed. In this regard, the pocket area 31 can include dimensions suitable to allow the main body and pocket area to accommodate any number of commercially available folded napkins which can be dispensed through the opening 32.

In various embodiments, the pocket area can be accessible wherein the back wall 12 is removably attached to the main body and/or is attached to the main body via one or more hinges so as to pivot between an open and closed position. Although illustrated along the back wall of the device, other embodiments are contemplated wherein the napkin dispenser is located along one or more of the other walls of the main body.

As described herein, the main body, the drawer, the template, the condiment receptacles, and the napkin dispenser may each be formed from any number of generally lightweight materials that are relatively strong and stiff for their weight. Several nonlimiting examples include but are not limited to various metals or metal alloys, plastics or polymers, and/or various composite materials, for example. Each of the components can be assembled so as to form the illustrated shapes or may be formed to create different shapes and sizes that function in the manner described herein.

As described herein, one or more elements of the tabletop game and condiment holder 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A condiment holding device, comprising:

a main body having a top wall, a bottom wall, a back wall, a front wall and a pair of side walls;

a curved wall that extends from the top wall to the front wall;

an opening positioned along the front wall;

a drawer that is removably positioned within the opening; and a napkin dispenser having a pocket that is positioned within the main body and a pocket opening that is disposed along the back wall of the main body, wherein the curved wall forms a ramp that is configured to launch a coin away from the front wall, wherein the drawer includes a plurality of side walls and a top wall, and wherein the top wall includes a plurality of apertures that are each configured to receive the coin.

2. The device of claim 1, further comprising:

at least one condiment receptacle that is positioned along the main body.

3. The device of claim 1, further comprising:

a first condiment receptacle that is positioned along one of the pair of side walls, and a second condiment receptacle that is positioned along the other of the pair of side walls.

4. The device of claim 1, wherein at least one of the plurality of apertures includes a size that is different from a size of another of the plurality of apertures.

5. The device of claim 1, wherein at least one of the plurality of apertures includes a shape that is different from a shape of another of the plurality of apertures.

6. The device of claim 1, wherein at least one of the plurality of apertures includes a shape and a size that is different from a shape and a size of another of the plurality of apertures.

7. The device of claim 1, wherein the pocket is configured to receive a plurality of folded napkins.

8. The device of claim 7, wherein the pocket extends from the back wall toward the front wall of the main body.

9. The device of claim 7, said pocket opening being in communication with the pocket and being configured to permit the plurality of folded napkins to be selectively discharged.

* * * * *